US009136604B2

(12) United States Patent
Liu et al.

(10) Patent No.: US 9,136,604 B2
(45) Date of Patent: Sep. 15, 2015

(54) ANTENNA AND WIRELESS COMMUNICATION APPARATUS

(75) Inventors: Ruopeng Liu, Guangdong (CN); Guanxiong Xu, Guangdong (CN); Nenghui Fang, Guangdong (CN)

(73) Assignee: KUANG-CHI INTELLIGENT PHOTONIC TECHNOLOGY LTD., Futian District, Shenzhen, Guangdong (CN)

( * ) Notice: Subject to any disclaimer, the term of this patent is extended or adjusted under 35 U.S.C. 154(b) by 412 days.

(21) Appl. No.: 13/521,444

(22) PCT Filed: Sep. 30, 2011

(86) PCT No.: PCT/CN2011/080410

§ 371 (c)(1),
(2), (4) Date: Jul. 10, 2012

(87) PCT Pub. No.: WO2013/000210

PCT Pub. Date: Jan. 3, 2013

(65) Prior Publication Data

US 2013/0002490 A1 Jan. 3, 2013

(30) Foreign Application Priority Data

Jun. 29, 2011 (CN) ..... 2011 1 0178651
Jun. 29, 2011 (CN) ..... 2011 1 0178654

(51) Int. Cl.
*H01Q 1/38* (2006.01)
*H01Q 9/42* (2006.01)

(52) U.S. Cl.
CPC ..... *H01Q 9/42* (2013.01)

(58) Field of Classification Search
CPC ..... H01Q 9/42
USPC ..... 343/700 MS
See application file for complete search history.

(56) References Cited

U.S. PATENT DOCUMENTS 5,847,682 A * 12/1998 Ke ..... 343/752

FOREIGN PATENT DOCUMENTS

CN 101740862 A * 6/2010

* cited by examiner

*Primary Examiner* — Dieu H Duong
(74) *Attorney, Agent, or Firm* — Winston Hsu; Scott Margo

(57) ABSTRACT

An antenna comprises a medium substrate and grounding units attached on the medium substrate. The antenna further comprises a metal structure attached on the medium substrate. The metal structure comprises an electromagnetic response unit, a metal open ring enclosing the electromagnetic response unit and a feeding point connected to an end of the metal open ring. The electromagnetic response unit comprises an electric-field coupling structure. This design increases the physical length of the antenna equivalently, so an RF antenna operating at an extremely low frequency can be designed within a very small space. This can eliminate the physical limitation imposed by the spatial area when the conventional antenna operates at a low frequency, and satisfy the requirements of miniaturization, a low operating frequency and broadband multi-mode services for the mobile phone antenna. Meanwhile, a solution of a lower cost is provided for design of the antenna of wireless communication apparatuses.

20 Claims, 10 Drawing Sheets

ANTENNA AND WIRELESS COMMUNICATION APPARATUS

FIELD OF THE INVENTION

The present disclosure generally relates to the technical field of antenna, and more particularly, to an antenna and a wireless communication apparatus using the same.

BACKGROUND OF THE INVENTION

With advancement of the semiconductor manufacturing processes, requirements on the integration level of modern electronic systems become increasingly higher, and correspondingly, miniaturization of components has become a problem of great concern in the whole industry. However, unlike integrated circuit (IC) chips that advance following the Moore's Law, radio frequency (RF) modules which are known as another kind of important components in the electronic systems are very difficult to be miniaturized. An RF module mainly comprises a mixer, a power amplifier, a filter, an RF signal transmission component, a matching network and an antenna as key components thereof. The antenna acts as a transmitting unit and a receiving unit for RF signals, and the operation performances thereof have a direct influence on the operation performance of the overall electronic system. However, some important indicators of the antenna such as the size, the bandwidth and the gain are restricted by the basic physical principles (e.g., the gain limit under the limitation of a fixed size, and the bandwidth limit). The limits of these indicators make miniaturization of the antenna much more difficult than miniaturization of other components; and furthermore, due to complexity of analysis of the electromagnetic field of the RF component, even approximately reaching these limits represents a great technical challenge.

Meanwhile, as the modern electronic systems become more and more complex, the multi-mode services become increasingly important in wireless communication systems, wireless accessing systems, satellite communication systems, wireless data network systems and the like. The demands for multi-mode services further increase the complexity of the design of miniaturized multi-mode antenna. In addition to the technical challenge presented by miniaturization, multi-mode impedance matching of the antenna has also become a technical bottleneck for the antenna technologies. However, the communication antenna of conventional terminals are designed primarily on the basis of the electric monopole or dipole radiating principles, an example of which is the most common planar inverted F antenna (PIFA). For a conventional antenna, the radiating operation frequency thereof is positively correlated with the size of the antenna directly, and the bandwidth is positively correlated with the area of the antenna, so the antenna usually has to be designed to have a physical length of a half wavelength. Besides, in some more complex electronic systems, the antenna needs to operate in a multi-mode condition, and this requires use of an additional impedance matching network design at the upstream of the in feed antenna. However, the additional impedance matching network adds to the complexity in design of the feeder line of the electronic systems and increases the area of the RF system and, meanwhile, the impedance matching network also leads to a considerable energy loss. This makes it difficult to satisfy the requirement of a low power consumption in the design of the electronic systems. Accordingly, how to develop a miniaturized and multi-mode novel antenna has become an important technical bottleneck for the modern integrated electronic systems.

SUMMARY OF THE INVENTION

In view of the shortcomings of the prior art mobile phone antenna that it is difficult to satisfy the design requirements of a low power consumption, miniaturization and multi-function in modern communication systems due to the limitation imposed by the physical length of a half wavelength, an objective of the present disclosure is to provide a miniaturized antenna that has a low power consumption and multiple resonant frequencies.

To achieve the aforesaid objective, the present disclosure provides an antenna, which comprises a medium substrate, grounding units attached on the medium substrate and a metal structure attached on the medium substrate. The metal structure comprises an electromagnetic response unit, a metal open ring enclosing the electromagnetic response unit and a feeding point connected to an extended end of the metal open ring. The electromagnetic response unit comprises an electric-field coupling structure.

According to a preferred embodiment of the present disclosure, the electromagnetic response unit further comprises at least one metal substructure, which is disposed in the electric-field coupling structure and integrally coupled or connected with the electric-field coupling structure.

According to a preferred embodiment of the present disclosure, the electromagnetic response unit comprises four said metal substructures.

According to a preferred embodiment of the present disclosure, each of the metal substructures is either of a pair of complementary split ring resonator metal substructures.

According to a preferred embodiment of the present disclosure, the split ring resonator metal substructure is formed into any of a split curved metal substructure, a split triangular metal substructure and a split polygonal metal substructure through geometry derivation.

According to a preferred embodiment of the present disclosure, the split ring resonator metal substructure is a complementary derivative structure.

According to a preferred embodiment of the present disclosure, each of the metal substructures is either of a pair of complementary spiral line metal substructures.

According to a preferred embodiment of the present disclosure, each of the metal substructures is either of a pair of complementary meander line metal substructures.

According to a preferred embodiment of the present disclosure, each of the metal substructures is either of a pair of complementary split spiral ring metal substructures.

According to a preferred embodiment of the present disclosure, the medium substrate is provided with grounding units on two opposite surfaces thereof respectively, with at least one metallization via being formed in each of the grounding units.

According to a preferred embodiment of the present disclosure, the two opposite surfaces of the medium substrate are each attached with the metal structure.

According to a preferred embodiment of the present disclosure, the metal structures attached on the two opposite surfaces of the medium substrate are of the same form.

According to a preferred embodiment of the present disclosure, the metal structures attached on the two opposite surfaces of the medium substrate are of different forms.

According to a preferred embodiment of the present disclosure, the medium substrate is made of any of a ceramic material, a polymer material, a ferroelectric material, a ferrite material and a ferromagnetic material.

To achieve the aforesaid objective, the present disclosure further provides a wireless communication apparatus, which comprises a printed circuit board (PCB) and an antenna connected to the PCB. The antenna comprises a medium substrate, grounding units attached on the medium substrate and a metal structure attached on the medium substrate. The metal structure comprises an electromagnetic response unit, a metal open ring enclosing the electromagnetic response unit and a feeding point connected to an extended end of the metal open ring. The electromagnetic response unit comprises an electric-field coupling structure.

According to a preferred embodiment of the present disclosure, the electromagnetic response unit further comprises at least one metal substructure, which is disposed in the electric-field coupling structure and integrally coupled or connected with the electric-field coupling structure.

According to a preferred embodiment of the present disclosure, the electromagnetic response unit comprises four said metal substructures.

According to a preferred embodiment of the present disclosure, each of the metal substructures is either of a pair of complementary split ring resonator metal substructures, either of a pair of complementary spiral line metal substructures, either of a pair of complementary meander line metal substructures, or either of a pair of complementary split spiral ring metal substructures.

According to a preferred embodiment of the present disclosure, the split ring resonator metal substructure is formed into any of a split curved metal substructure, a split triangular metal substructure and a split polygonal metal substructure through geometry derivation.

This design increases the physical length of the antenna equivalently, so an RF antenna operating at an extremely low frequency can be designed within a very small space. This can eliminate the physical limitation imposed by the spatial area when the conventional antenna operates at a low frequency, and satisfy the requirements of miniaturization, a low operating frequency and broadband multi-mode services for the mobile phone antenna. Meanwhile, a solution of a lower cost is provided for design of the antenna of wireless communication apparatuses.

BRIEF DESCRIPTION OF THE DRAWINGS

To describe the technical solutions of embodiments of the present disclosure more clearly, the attached drawings necessary for description of the embodiments will be introduced briefly hereinbelow. Obviously, these attached drawings only illustrate some of the embodiments of the present disclosure, and those of ordinary skill in the art can further obtain other attached drawings according to these attached drawings without making inventive efforts. In the attached drawings.

DETAILED DESCRIPTION OF THE INVENTION

Hereinbelow, the present disclosure will be detailed with reference to the attached drawings.

Figure 1:
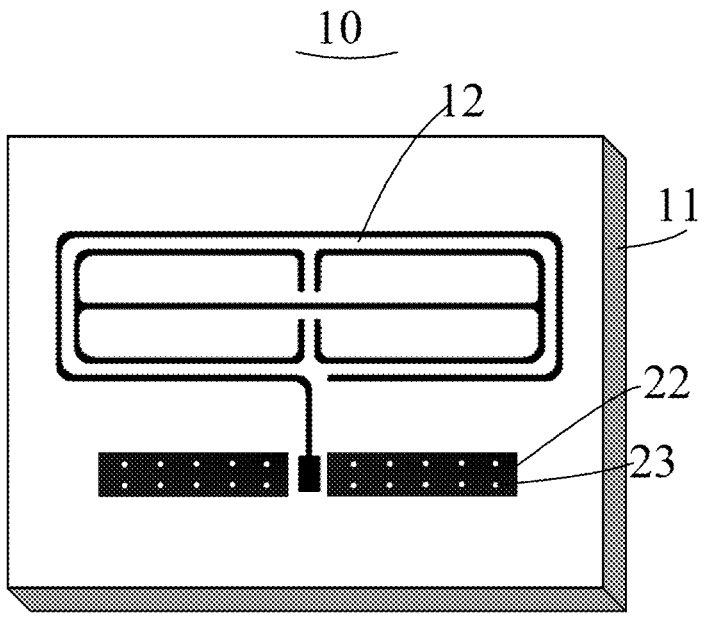
FIG. 1 is a perspective view illustrating a first embodiment of an antenna of the present disclosure.

Referring to FIG. 1, there is shown a perspective view illustrating an embodiment of an antenna of the present disclosure. The antenna 10 comprises a medium substrate 11, and a metal structure 12 and grounding units 22 that are both attached on the medium substrate 11. Each of the grounding units 22 is a metal sheet, and has at least one metallization via 23 formed therein. In this embodiment, the metal structure 12 is attached on a surface of the medium substrate 11 of the antenna 10; the medium substrate 11 is provided with the grounding units 22 on two opposite surfaces thereof respectively; and the medium substrate 11 is also formed with a via(s) (not shown) at a position(s) corresponding to the at least one metallization via 23, and the scattered grounding units 22 are electrically connected through the at least one metallization via 23 to form a common ground. In other embodiments, the two opposite surfaces of the medium substrate 11 of the antenna 10 are both attached with the metal structure 12 and the grounding units 22.

Figure 2:
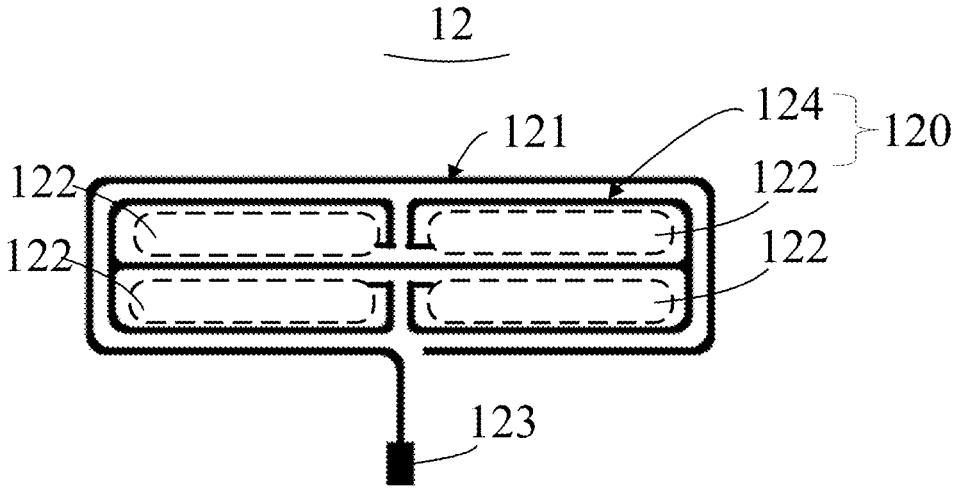
FIG. 2 is a schematic view illustrating a metal structure of the antenna in FIG. 1.

Referring to FIG. 2, the metal structure 12 is adapted to receive a baseband signal to generate an electromagnetic wave or generate an electric baseband signal in response to an electromagnetic signal. The metal structure 12 comprises an electromagnetic response unit 120, a metal open ring 121 enclosing the electromagnetic response unit 120 and a feeding point 123 connected to an extended end of the metal open ring 121. The electromagnetic response unit 120 is adapted to receive a baseband signal or transmit an electric baseband signal. The electromagnetic response unit 120 comprises one electric-field coupling structure 124. This design increases the physical length of the antenna equivalently without increasing the actual length, so an RF antenna operating at an extremely low frequency can be designed within a very small space. This can eliminate the physical limitation imposed by the spatial area when the conventional antenna operates at a low frequency.

The aforesaid antenna is designed on the basis of the man-made electromagnetic material technologies. The man-made electromagnetic material refers to an equivalent special electromagnetic material produced by enchasing a metal sheet into a topology metal structure of a particular form and disposing the topology metal structure of the particular form on a substrate having a certain dielectric constant and a certain magnetic permeability. Performance parameters of the man-made electromagnetic material are mainly determined by the subwavelength topology metal structure of the particular form. In the resonance waveband, the man-made electromagnetic material usually exhibits a highly dispersive characteristic; i.e., the impedance, the capacitance and the inductance, the equivalent dielectric constant and the magnetic permeability of the antenna vary greatly with the frequency. Therefore, the basic characteristics of the antenna can be altered according to the man-made electromagnetic material technologies so that the metal structure and the medium substrate attached thereto equivalently form a special electromagnetic material that is highly dispersive, thus achieving a novel antenna with rich radiation characteristics.

Figure 3:
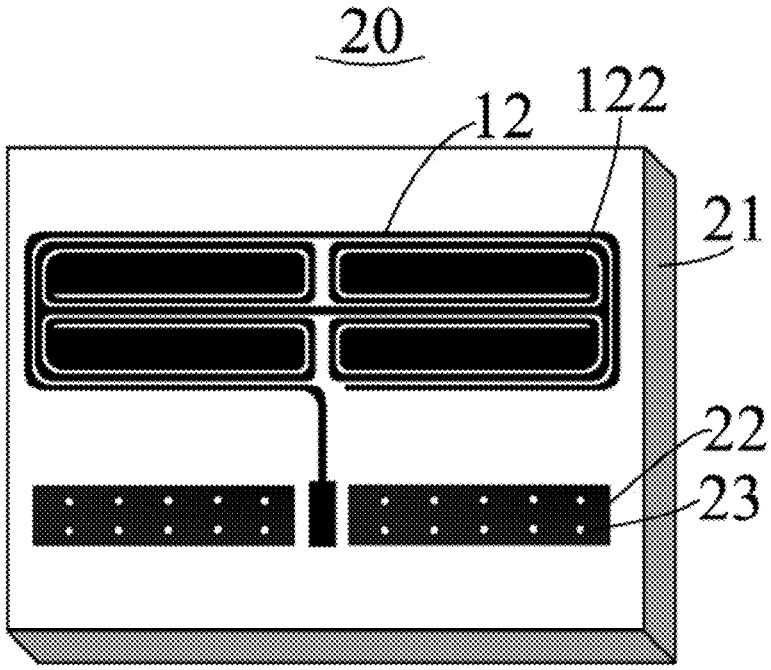
FIG. 3 is a perspective view illustrating a second embodiment of the antenna of the present disclosure.

Referring to FIG. 2 and FIG. 3, a schematic view of the metal structure of the antenna and a perspective view of a second embodiment of the antenna of the present disclosure are shown therein. In order to achieve impedance matching and improve the performance of the antenna 10, the antenna 10 may be further modified. The metal structure 12 further comprises at least one metal substructure 122, which is embedded in the electric-field coupling structure 124 of the electromagnetic response unit 120. In this embodiment, four identical metal substructures 122 are embedded in the electric-field coupling structure 124 respectively and connected integrally with the electric-field coupling structure 124 (as shown in FIG. 3). In other embodiments, the four identical metal substructures 122 may be connected with the electric-field coupling structure 124 directly through electric-field coupling or inductive coupling.

At least two of the four metal substructures 122 are of different forms. That is, the four metal substructures 122 may be completely or partially different from each other.

Various wireless communication apparatuses all can use the antenna 10 or 20 of the present disclosure. However, in order to achieve impedance matching between the antenna 10 or 20 and the various wireless communication apparatuses or to achieve the multi-mode operation, various metal substructures responsive to the electromagnetic wave or derivative structures thereof may be used for the metal substructures 122. For example, the metal substructures 122 may be complementary split ring resonator metal substructures (as shown in FIG. 4 and FIG. 5), i.e., the two metal substructures as shown in FIG. 4 and FIG. 5 that are complementary to each other in form.

Figure 4:
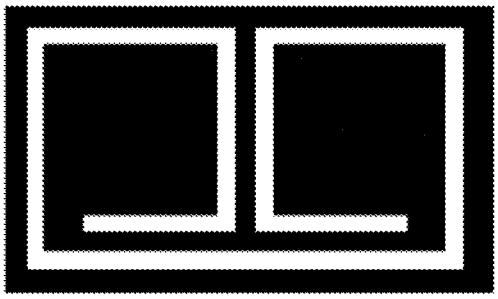
FIG. 4 is a plan view illustrating the metal structure in FIG. 2 which is a split ring resonator metal substructure.
Figure 5:
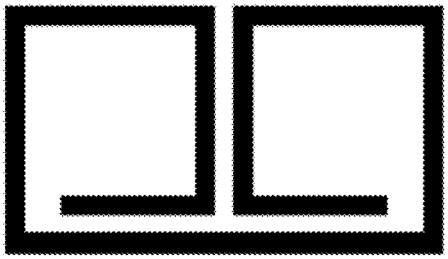
FIG. 5 is a plan view illustrating a complementary metal substructure of the split ring resonator metal substructure shown in FIG. 4.
Figure 14:
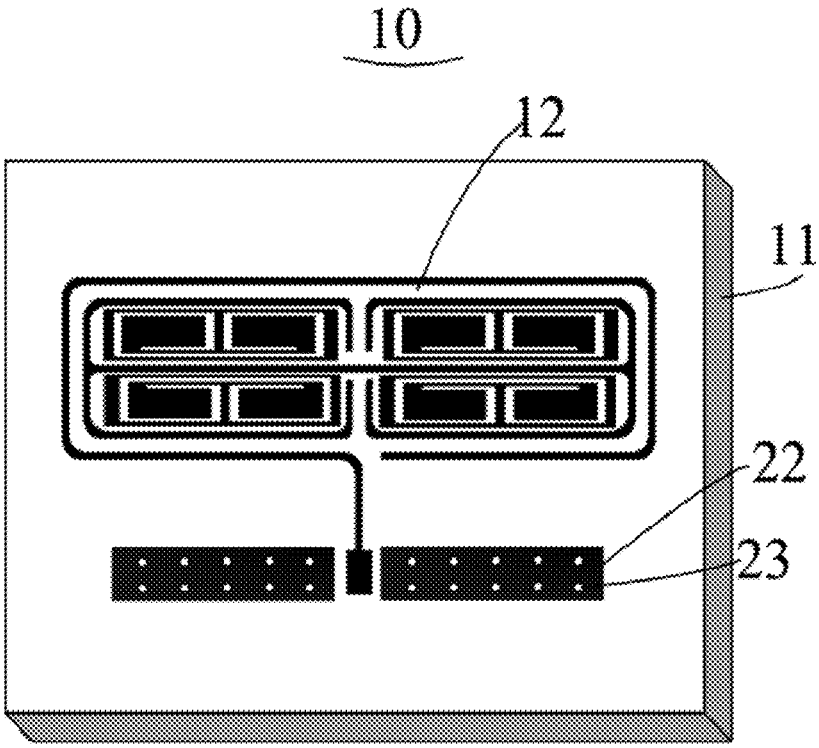
FIG. 14 is a perspective view illustrating a third embodiment of the antenna of the present disclosure.

The metal substructures 122 shown in FIG. 4 and FIG. 5 are a pair of complementary split ring resonator metal substructures. The metal substructure 122 shown in FIG. 4 is not provided with a connection end, so it may be disposed in the metal structure 12 through coupling so as to form the antenna 10 (as shown in FIG. 14) of the present disclosure. Likewise, the metal substructure 122 shown in FIG. 5 is not provided with a connection end either, so the metal substructure 122 shown in FIG. 5 may also be disposed in the metal structure 12 through coupling.

Figure 6:
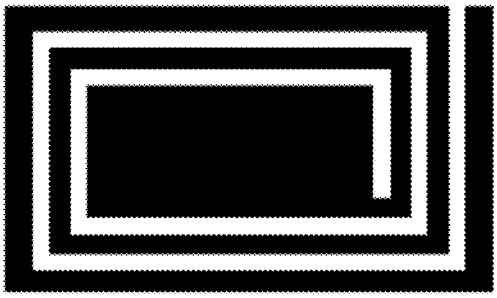
FIG. 6 is a plan view illustrating the metal structure in FIG. 2 which is a spiral line metal substructure.
Figure 7:
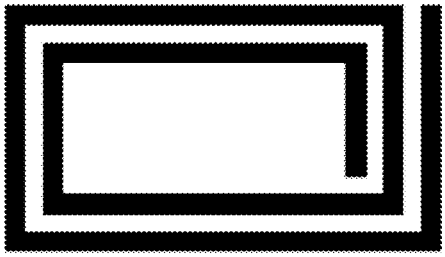
FIG. 7 is a plan view illustrating a complementary metal substructure of the spiral line metal substructure shown in FIG. 6.
Figure 8:
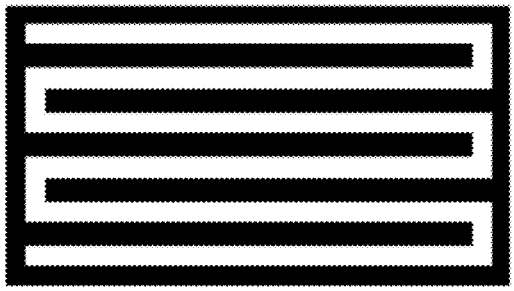
FIG. 8 is a plan view illustrating the metal structure in FIG. 2 which is a meander line metal substructure.
Figure 9:
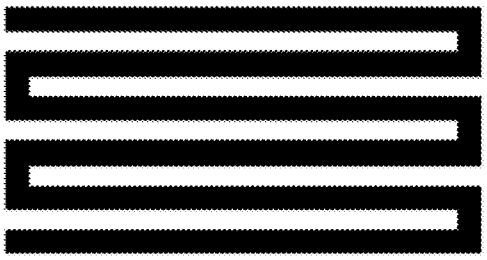
FIG. 9 is a plan view illustrating a complementary metal substructure of the meander line metal substructure shown in FIG. 8.
Figure 10:
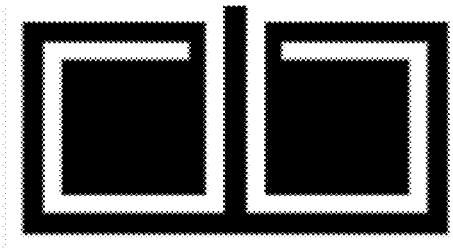
FIG. 10 is a plan view illustrating the metal structure in FIG. 2 which is a split spiral ring metal substructure.
Figure 11:
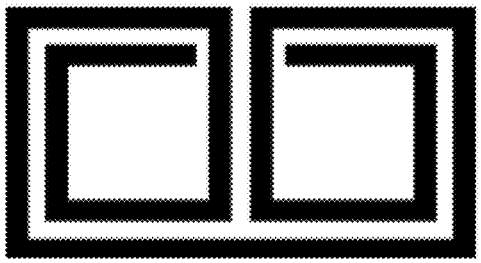
FIG. 11 is a plan view illustrating a complementary metal substructure of the split spiral ring metal substructure shown in FIG. 10.
Figure 12:
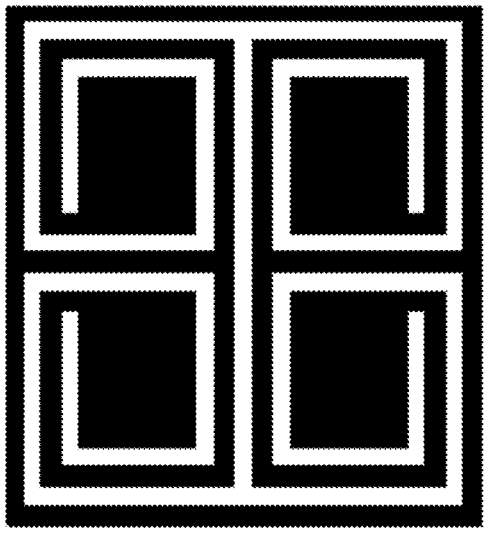
FIG. 12 is a plan view illustrating the metal structure in FIG. 2 which is a dual split spiral ring metal substructure.
Figure 13:
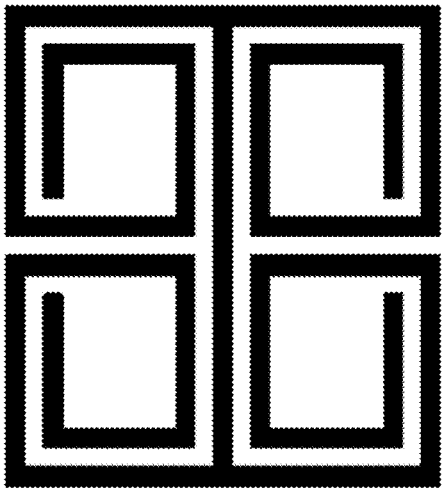
FIG. 13 is a plan view illustrating a complementary metal substructure of the dual split spiral ring metal substructure shown in FIG. 12.
Figure 15:
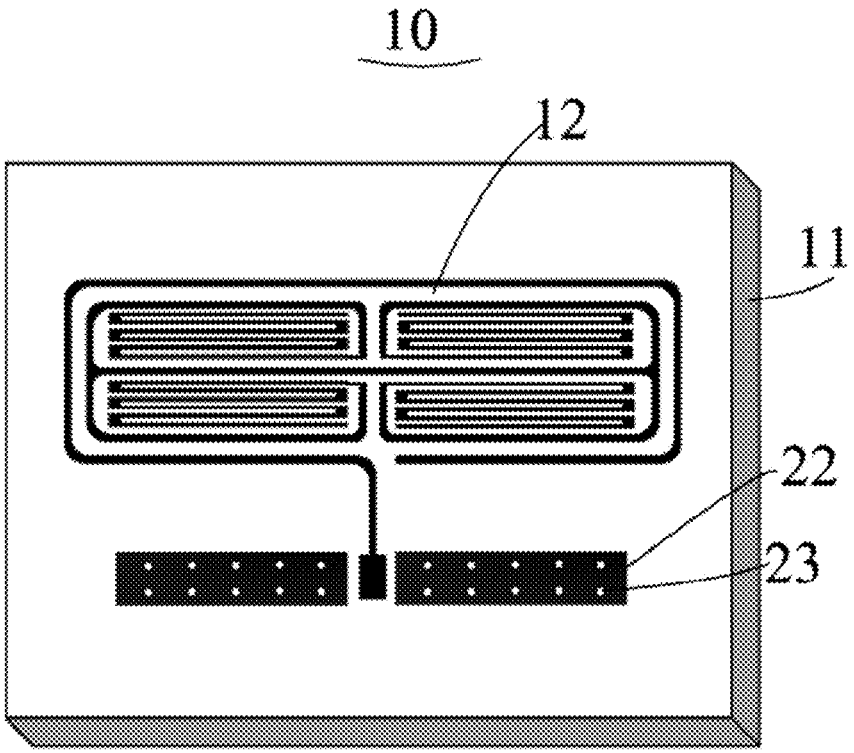
FIG. 15 is a perspective view illustrating a fourth embodiment of the antenna of the present disclosure.

The metal substructures 122 may also be a pair of complementary spiral line metal substructures as shown in FIG. 6 and FIG. 7, a pair of complementary meander line metal substructures as shown in FIG. 8 and FIG. 9, a pair of complementary split spiral ring metal substructures as shown in FIG. 10 and FIG. 11, or a pair of complementary dual split spiral ring metal substructures as shown in FIG. 12 and FIG. 13. If each of the metal substructures 122 is provided with a connection end, then the metal substructures 122 may be connected with the metal structure 12 directly, an example of which is the metal substructure 122 shown in FIG. 9. Referring to FIG. 15 together, the metal substructure 122 shown in FIG. 9 is electrically connected to the electric-field coupling structure 124 of the metal structure 12 so as to obtain a derivative antenna 10 of the present disclosure. Bends formed in the aforesaid metal substructures 122 are all of a right-angled form. In other embodiments, the bends formed in the metal substructures 122 are in the form of a round corner; for example, the bends formed in the electromagnetic response unit 120 are in the form of the round corner.

Figure 16:
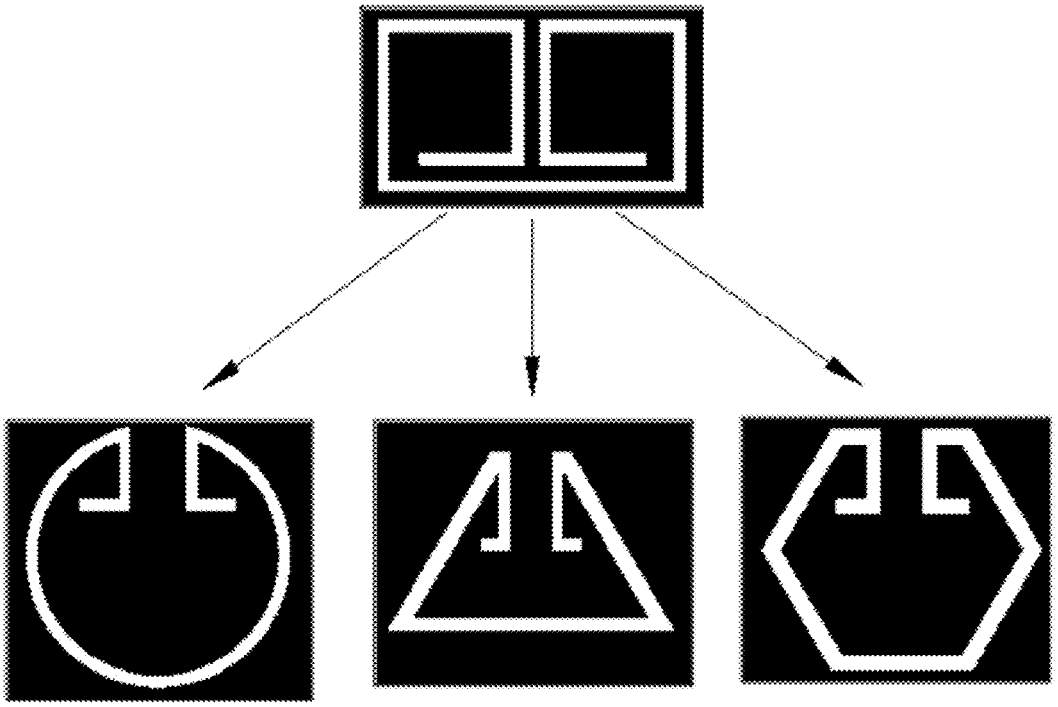
FIG. 16 is a schematic view illustrating geometry derivations of the split ring resonator metal substructure shown in FIG. 4.
Figure 17:
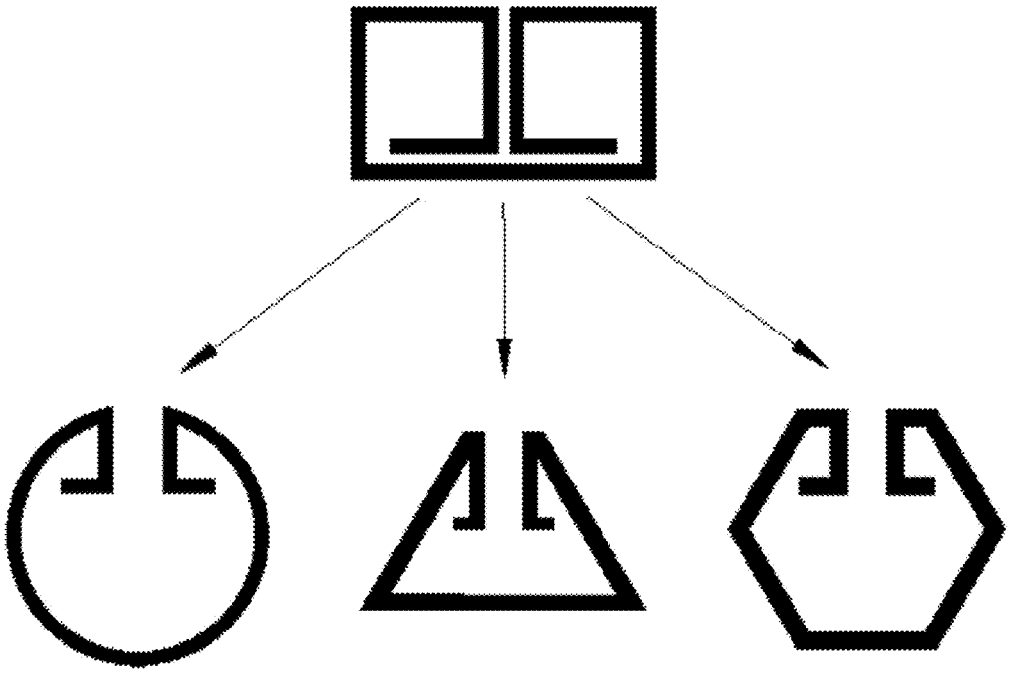
FIG. 17 is a schematic view illustrating geometry derivations of the complementary split ring resonator metal substructure shown in FIG. 5.

Each of the metal substructures 122 may be obtained through derivation, combination or arraying of one or more of the aforesaid structures. The derivation is classified into geometry derivation and extension derivation. The geometry derivation herein refers to derivation of structures having similar functions but different forms, for example, derivation of a split curved metal substructure, a split triangular metal substructure, a split polygonal metal substructure and other different polygonal substructures from rectangular frame structures. As an example, FIG. 16 is a schematic view illustrating geometry derivations of the split ring resonator metal substructure shown in FIG. 5. Through the geometry derivation described above, corresponding complementary derivative structures can be obtained, for example, the complementary derivative structures formed based on the split ring resonator metal substructure (as shown in FIG. 17).

Figure 18:
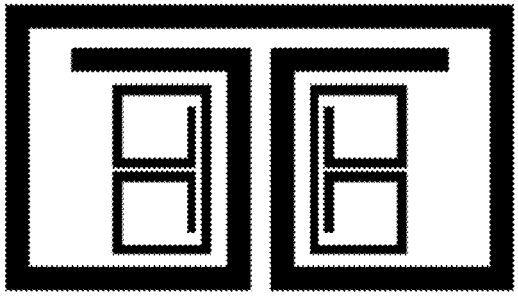
FIG. 18 is a plan view illustrating a metal substructure obtained through combination of three said complementary split ring resonator metal substructures shown in FIG. 5.
Figure 19:
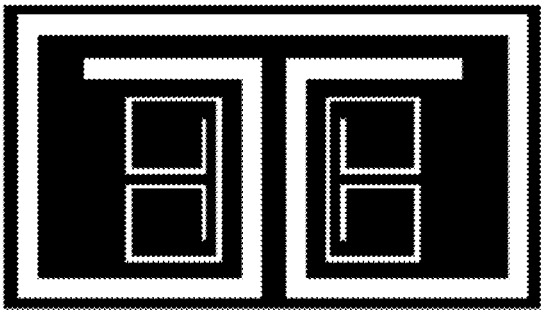
FIG. 19 is a plan view illustrating a complementary metal substructure of the metal substructure shown in FIG. 18.

The extension derivation herein refers to forming a composite metal substructure through combination of the metal substructures shown in FIG. 4 to FIG. 13. The combination herein means that at least two of the metal substructures shown in FIG. 4 to FIG. 13 are combined and superposed into one composite metal substructure 122. The composite metal substructure as shown in FIG. 18 is formed through combination of three complementary split ring resonator metal substructures as shown in FIG. 5. Correspondingly, a complementary composite metal substructure (as shown in FIG. 19) is obtained from the metal substructure as shown in FIG. 18.

In the present disclosure, in the case where the two opposite surfaces of the medium substrate 11 or 21 are both attached with metal structures 12, the metal structures 12 on the two surfaces may or may not be connected to each other. When the metal structures 12 on the two surfaces are not connected to each other, the electric energy is fed through capacitive coupling between the metal structures 12 on the two surfaces; and in this case, by changing the thickness of the medium substrate 11 or 21, resonance of the metal structures 12 on the two surfaces can be achieved. When the metal structures 12 on the two surfaces are connected to each other (e.g., through wires or metallization vias), the electric energy is fed through inductive coupling between the metal structures 12 on the two surfaces.

In the present disclosure, the medium substrates 11, 21 are made of any of a ceramic material, a polymer material, a ferroelectric material, a ferrite material and a ferromagnetic material. Preferably, the medium substrates 11, 21 are made of a polymer material, which may be FR-4, F4B and so on.

In the present disclosure, the metal structure 12 is made of copper or silver. Preferably, the metal structure 12 is made of copper because copper is inexpensive and has a good electrical conductivity. In order to achieve better impedance matching, the metal structure 12 may also be made of a combination of copper and silver. For example, the electromagnetic response unit 120 and the metal substructures 122 are made of silver while the metal open ring 121 and the feeding point 123 are made of copper. In this way, many kinds of metal structures 12 made of the combination of copper and silver can be obtained.

In the present disclosure, the antenna may be manufactured in various ways so long as the design principle of the present disclosure is followed. The most common method is to adopt manufacturing methods of various printed circuit boards (PCBs), and both the manufacturing method of a PCB formed with metallized through-holes and that of a PCB covered by copper on both surfaces thereof can satisfy the processing requirement of the present disclosure. Apart from this, other processing means may also be used depending on actual requirements, for example, the conductive silver paste & ink processing for the radio frequency identification (RFID), the flexible PCB processing for various deformable components, the ferrite sheet antenna processing, and the processing means of the ferrite sheet in combination with the PCB. The processing means of the ferrite sheet in combination with the PCB means that the chip microstructure portion is processed by an accurate processing process for the PCB and other auxiliary portions are processed by using ferrite sheets. Furthermore, the antenna may be manufactured through etching, electroplating, drilling, photolithography, electron etching or ion etching.

Figure 20:
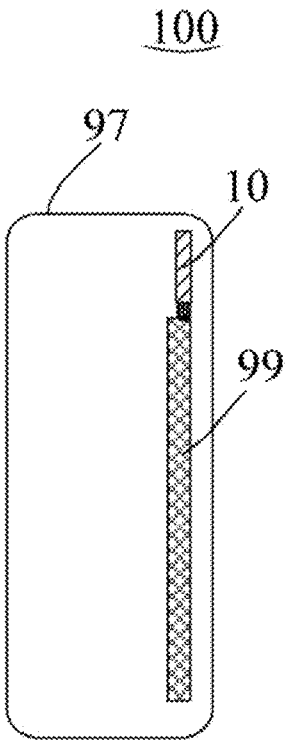
FIG. 20 illustrates a wireless communication apparatus using the antenna of the present disclosure.

Referring to FIG. 20, there is shown a wireless communication apparatus 100 using the aforesaid antenna. The wireless communication apparatus comprises one apparatus housing 97, a printed circuit board (PCB) 99 disposed in the apparatus housing 97 and the antenna 10 of the present disclosure. The antenna 10 is connected to the PCB 99. The antenna 10 is adapted to receive an electromagnetic signal and convert the electromagnetic signal into an electric signal which is then transmitted to the PCB 99 for processing. It shall be appreciated that, the wireless communication apparatus 100 may also use the antenna 20, and this will not be further described herein.

With the design idea of the antenna of the present disclosure, an impedance matching antenna can be easily designed according to communication wavebands of various wireless communication apparatuses. The wireless communication apparatus 100 includes but is not limited to a wireless access point (AP), a mobile phone, a mobile multimedia apparatus, a WIFI apparatus, a personal computer (PC), a Bluetooth apparatus, a wireless router, a wireless network accessing card, a navigation device or the like.

The embodiments of the present disclosure have been described above with reference to the attached drawings; however, the present disclosure is not limited to the aforesaid embodiments, and these embodiments are only illustrative but are not intended to limit the present disclosure. Those of ordinary skill in the art may further devise many other implementations according to the teachings of the present disclosure without departing from the spirits and the scope claimed in the claims of the present disclosure, and all of the implementations shall fall within the scope of the present disclosure.

What is claimed is:

1. An antenna, comprising a medium substrate and grounding units attached on the medium substrate, wherein the antenna further comprises a metal structure attached on the medium substrate, the metal structure comprises an electromagnetic response unit, a metal open ring enclosing the electromagnetic response unit and a feeding point connected to an extended end of the metal open ring, and the electromagnetic response unit comprises an electric-field coupling structure;

wherein the electromagnetic response unit is axially symmetrical with respect to a line passing through the extended end of the metal open ring.

2. The antenna of claim 1, wherein the electromagnetic response unit further comprises at least one metal substructure, which is disposed in the electric-field coupling structure and integrally coupled or connected with the electric-field coupling structure.

3. The antenna of claim 2, wherein the electromagnetic response unit comprises four said metal substructures.

4. The antenna of claim 2, wherein each of the metal substructures is either of a pair of complementary split ring resonator metal substructures.

5. The antenna of claim 4, wherein the split ring resonator metal substructure is formed into any of a split curved metal substructure, a split triangular metal substructure and a split polygonal metal substructure through geometry derivation.

6. The antenna of claim 5, wherein the split ring resonator metal substructure is a complementary derivative structure.

7. The antenna of claim 2, wherein each of the metal substructures is either of a pair of complementary spiral line metal substructures.

8. The antenna of claim 2, wherein each of the metal substructures is either of a pair of complementary meander line metal substructures.

9. The antenna of claim 2, wherein each of the metal substructures is either of a pair of complementary split spiral ring metal substructures.

10. The antenna of claim 1, wherein the medium substrate is provided with the grounding units on two opposite surfaces thereof respectively, with at least one metallization via being formed in each of the grounding units.

11. The antenna of claim 10, wherein the two opposite surfaces of the medium substrate are each attached with the metal structure.

12. The antenna of claim 11, wherein the metal structures attached on the two opposite surfaces of the medium substrate are of the same form.

13. The antenna of claim 11, wherein the metal structures attached on the two opposite surfaces of the medium substrate are of different forms.

14. The antenna of claim 10, wherein the medium substrate is made of any of a ceramic material, a polymer material, a ferroelectric material, a ferrite material and a ferromagnetic material.

15. The antenna of claim 1, wherein the electric-field coupling structure is a metal-line structure consisted of a plurality of metal lines which are connected with each other.

16. A wireless communication apparatus, comprising a printed circuit board (PCB) and an antenna connected to the PCB, wherein the antenna comprises a medium substrate, grounding units attached on the medium substrate and a metal structure attached on the medium substrate, the metal structure comprises an electromagnetic response unit, a metal open ring enclosing the electromagnetic response unit and a feeding point connected to an extended end of the metal open ring, and the electromagnetic response unit comprises an electric-field coupling structure;

wherein the electromagnetic response unit is axially symmetrical with respect to a line passing through the extended end of the metal open ring.

17. The wireless communication apparatus of claim 16, wherein the electromagnetic response unit further comprises at least one metal substructure, which is disposed in the electric-field coupling structure and integrally coupled or connected with the electric-field coupling structure.

18. The wireless communication apparatus of claim 17, wherein the electromagnetic response unit comprises four said metal substructures.

19. The wireless communication apparatus of claim 16, wherein each of the metal substructures is either of a pair of complementary split ring resonator metal substructures, either of a pair of complementary spiral line metal substructures, either of a pair of complementary meander line metal substructures, or either of a pair of complementary split spiral ring metal substructures.

20. The wireless communication apparatus of claim 19, wherein the split ring resonator metal substructure is formed into any of a split curved metal substructure, a split triangular metal substructure and a split polygonal metal substructure through geometry derivation.

* * * * *